US011607877B2

(12) United States Patent
Yokoi

(10) Patent No.: US 11,607,877 B2
(45) Date of Patent: Mar. 21, 2023

(54) PRINTING DEVICE, CLEANING UNIT, AND CONTROL METHOD FOR PRINTING DEVICE

(71) Applicant: FUJI CORPORATION, Chiryu (JP)

(72) Inventor: Yoshimune Yokoi, Kiyosu (JP)

(73) Assignee: FUJI CORPORATION, Chiryu (JP)

( * ) Notice: Subject to any disclaimer, the term of this patent is extended or adjusted under 35 U.S.C. 154(b) by 0 days.

(21) Appl. No.: 17/601,216

(22) PCT Filed: Apr. 26, 2019

(86) PCT No.: PCT/JP2019/017862
§ 371 (c)(1),
(2) Date: Oct. 4, 2021

(87) PCT Pub. No.: WO2020/217442
PCT Pub. Date: Oct. 29, 2020

(65) Prior Publication Data

US 2022/0176692 A1 Jun. 9, 2022

(51) Int. Cl.

| | |
|---|---|
| ***B41F 35/00*** | (2006.01) |
| ***B41F 15/12*** | (2006.01) |
| ***B41F 33/00*** | (2006.01) |

(52) U.S. Cl.
CPC ..... *B41F 35/003* (2013.01); *B41F 15/12* (2013.01); *B41F 33/0009* (2013.01)

(58) Field of Classification Search
USPC ..... 101/127
See application file for complete search history.

(56) References Cited

U.S. PATENT DOCUMENTS

2019/0018327 A1* 1/2019 Okawa ..... G03F 7/70925

FOREIGN PATENT DOCUMENTS

| | | | |
|---|---|---|---|
| EP | 2 818 320 | A1 | 12/2014 |
| JP | 2003-170564 | A | 6/2003 |
| JP | 3880850 | B2 | 2/2007 |
| JP | 2015-80870 | A | 4/2015 |

OTHER PUBLICATIONS

International Search Report dated Jun. 11, 2019 in PCT/JP2019/017862 filed on Apr. 26, 2019 (2 pages).

* cited by examiner

*Primary Examiner* — Leslie J Evanisko
(74) *Attorney, Agent, or Firm* — Oblon, McClelland, Maier & Neustadt, L.L.P.

(57) ABSTRACT

A printing device includes a cleaning head configured to contact a cleaning member with the screen mask to perform a cleaning process on the screen mask, a moving section connectable and disconnectable to the cleaning head to move the cleaning head between a cleaning area and a standby area, a door member configured to open and close an opening portion through which the cleaning member passes when the cleaning member is moved from the standby area to an outside of the printing device and be lockable in a closed state, and a control section configured to unlock the door member in a state where the moving section is disconnected to the cleaning head and the cleaning head is located in the standby area.

9 Claims, 8 Drawing Sheets

PRINTING DEVICE, CLEANING UNIT, AND CONTROL METHOD FOR PRINTING DEVICE

TECHNICAL FIELD

The present specification discloses a printing device, a cleaning unit, and a control method for a printing device.

BACKGROUND ART

Conventionally, in a printing device for performing a print process of a viscous fluid on a printing target such as a substrate using a screen mask, there has been proposed a device including a cleaning unit that contacts and cleans a rear surface of a screen mask (refer to Patent Literature 1, for example). In this printing device, when the cleaning unit is located in the replenishment area where a cleaning paper (cleaning member) is replenished, the cleaning member can be replenished, and thus, screen printing can be continued even during a replenishment work of the cleaning member.

PATENT LITERATURE

Patent Literature 1: JP-A-2015-80870

BRIEF SUMMARY

Technical Problem

However, in the above-described printing device, since an opening/closing cover is provided in the replenishment area, when the cleaning unit is not present in the replenishment area and the opening/closing cover is opened, a process related to the printing is stopped in consideration of security. As described above, in the printing device described in Patent Literature 1, the process related to printing may be interrupted.

The present disclosure has been made in view of such problems, and a main object of the present disclosure is to provide a printing device, a cleaning unit, and a control method for a printing device capable of further suppressing interruption of a process while securing security when exchanging a cleaning member used in the printing device.

Solution to Problem

A printing device, a cleaning unit, and a control method for the printing device disclosed in the present specification employs the following means in order to achieve the main object described above.

According to an aspect of the present disclosure, there is provided a printing device for performing a print process of a viscous fluid on a printing target using a screen mask, the printing device including: a cleaning section having a cleaning head configured to contact a cleaning member with the screen mask to perform a cleaning process on the screen mask; a moving section connectable and disconnectable to the cleaning section to move the cleaning section between a cleaning area and a standby area; a door member configured to open and close an opening portion through which the cleaning member passes when the cleaning member is moved from the standby area to an outside of the printing device and be lockable in a closed state; and a control section configured to unlock the door member in a state where the moving section and the cleaning section are disconnected from each other and in a state where the cleaning section is located in the standby area.

In this printing device, in the state where the moving section and the cleaning section are disconnected from each other and in the state where the cleaning section is located in the standby area, the door member that opens and closes the opening portion in the vicinity of the standby area is unlocked. In this printing device, when the door member is made openable, since the cleaning section is in the standby area and closes the opening portion, an operator is prevented from accessing inside of the device from the opening portion, and thus, security can be secured. In addition, when the printing device allows the door member to be opened, since the cleaning section is disconnected from the moving section, the cleaning section is also prevented from moving from the standby area. It should be noted that although the door member is locked in the closed state when the cleaning section is not in the standby area, there is no reason to open the door member, and thus, usability is not obstructed. Then, the operator can expose the cleaning member to the outside through the opening portion opened by the door member to exchange the cleaning member. Accordingly, in this printing device, when exchanging the cleaning member used in the printing device, it is possible to further suppress interruption of a process while securing security. Herein, examples of the "printing target" include a substrate on which a component is mounted, a three-dimensional object, or the like. In addition, examples of the "viscous fluid" include solder paste, conductive paste, and adhesive. In addition, an example of the cleaning member includes cleaning paper. Moreover, the expression "suppressing the interruption of the process" means suppressing the interruption of the process related to printing, and includes, for example, convey-in and convey-out processes of the printing target, a supply process of the viscous fluid, positioning processing between the screen mask and the printing target, or the like in addition to the print process itself.

DESCRIPTION OF EMBODIMENTS

Figure 1:
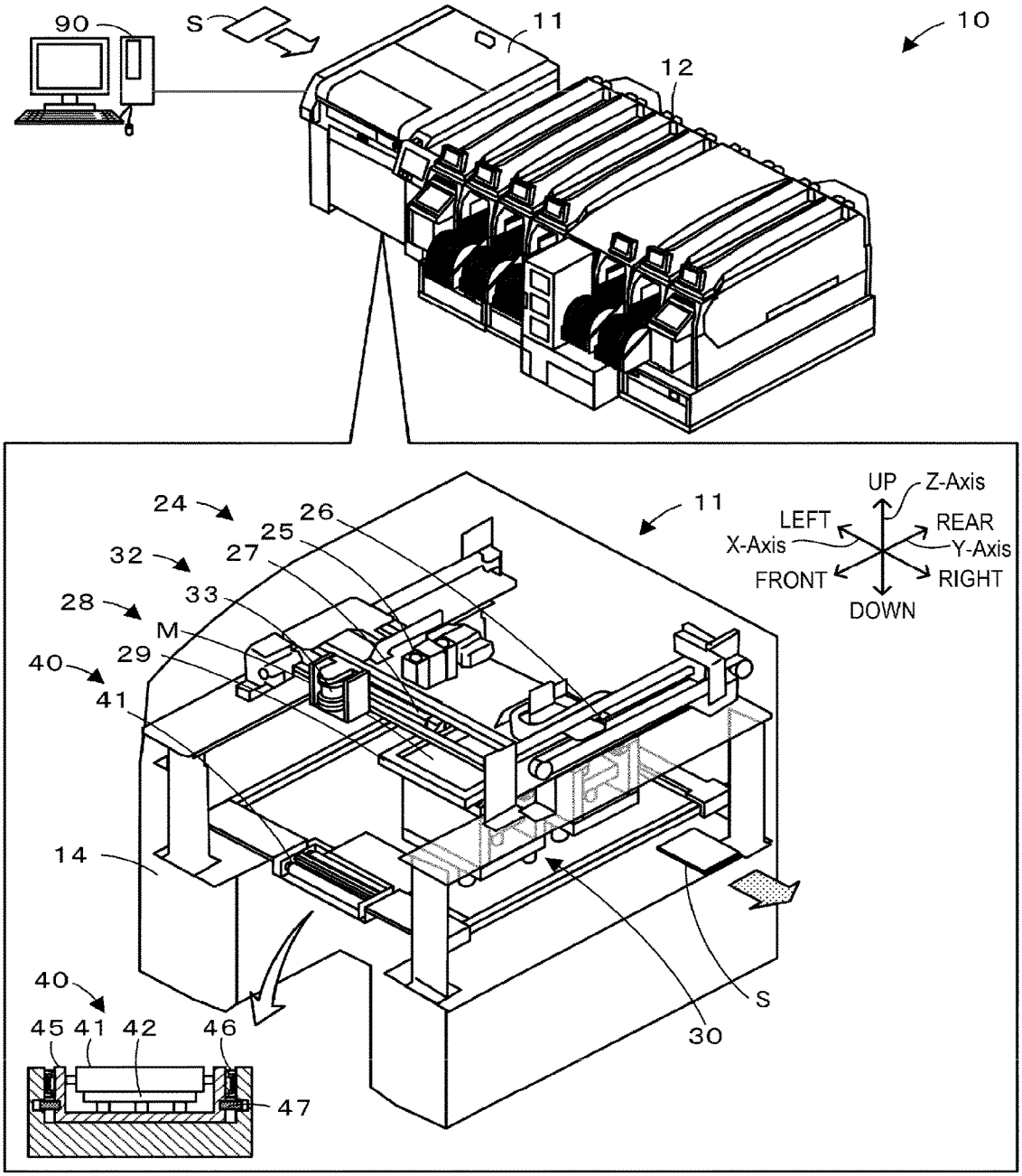
FIG. 1 is a schematic explanatory view illustrating an example of mounting system 10.
Figure 2:
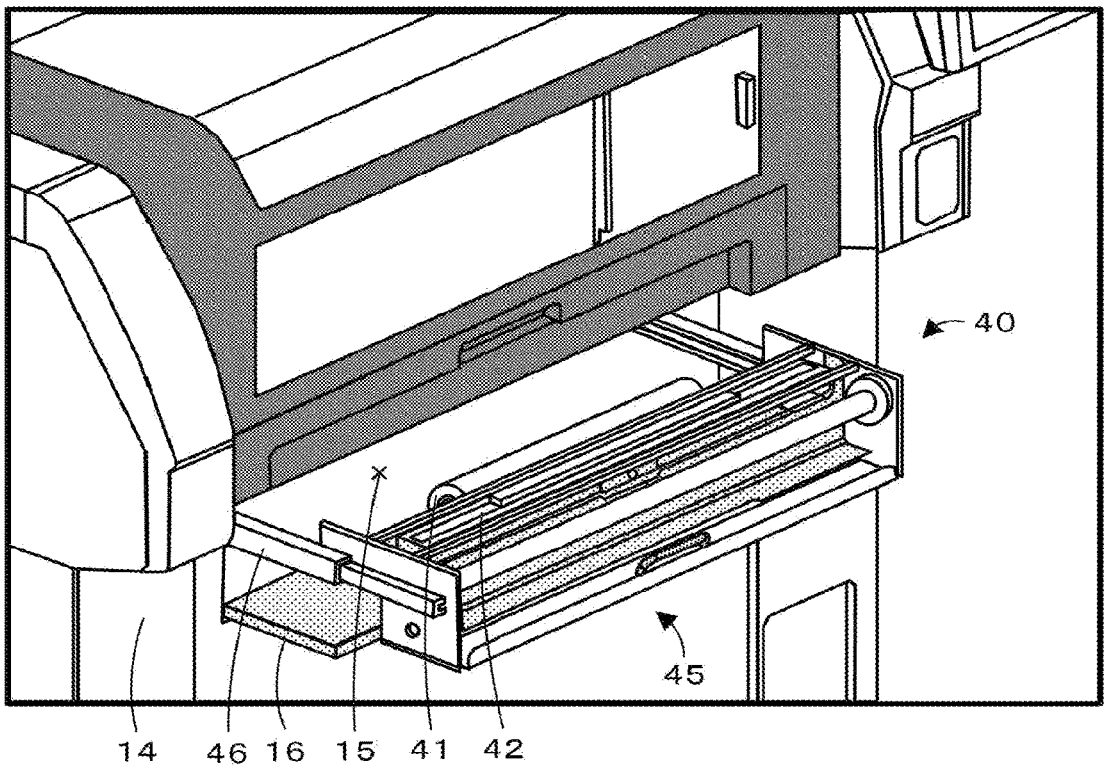
FIG. 2 is an explanatory view illustrating a state where door member 16 is opened and cleaning unit 40 is pulled out to an outside.
Figure 3:
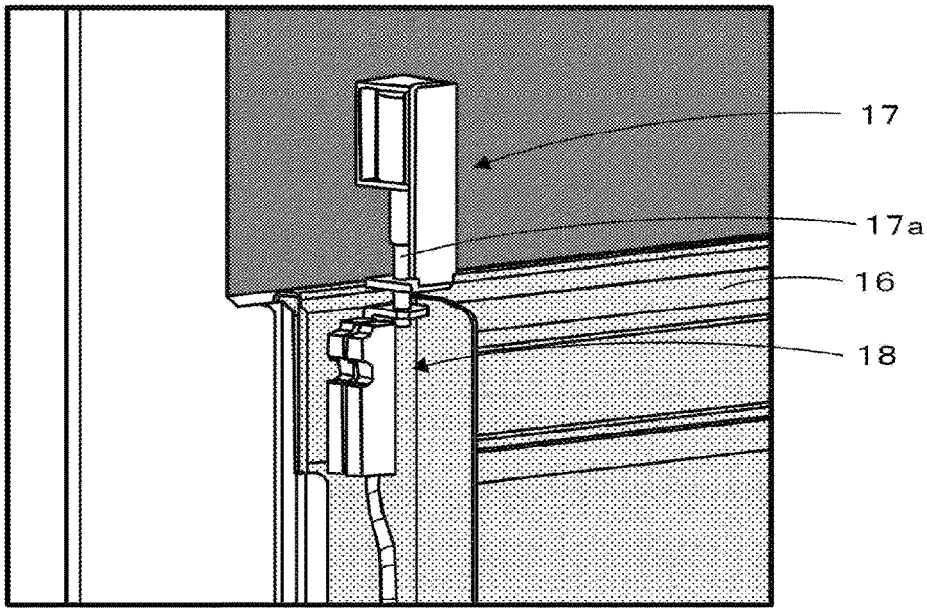
FIG. 3 is an explanatory view of closing mechanism 17 and closure sensor 18 as viewed from an inside of main body 14.
Figure 4A:
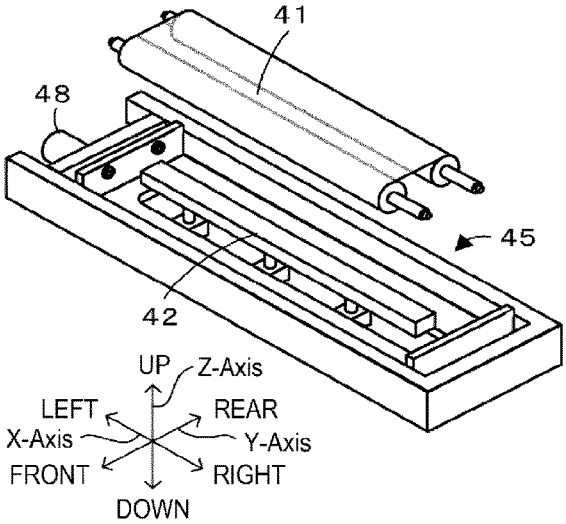
FIGS. 4A and 4B are explanatory views illustrating an example of a configuration of cleaning unit 40.
Figure 4B:
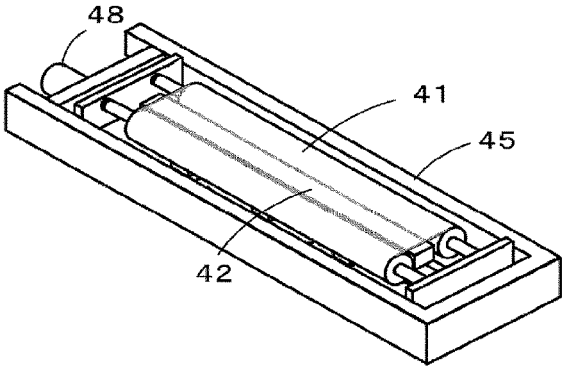
Figure 5:
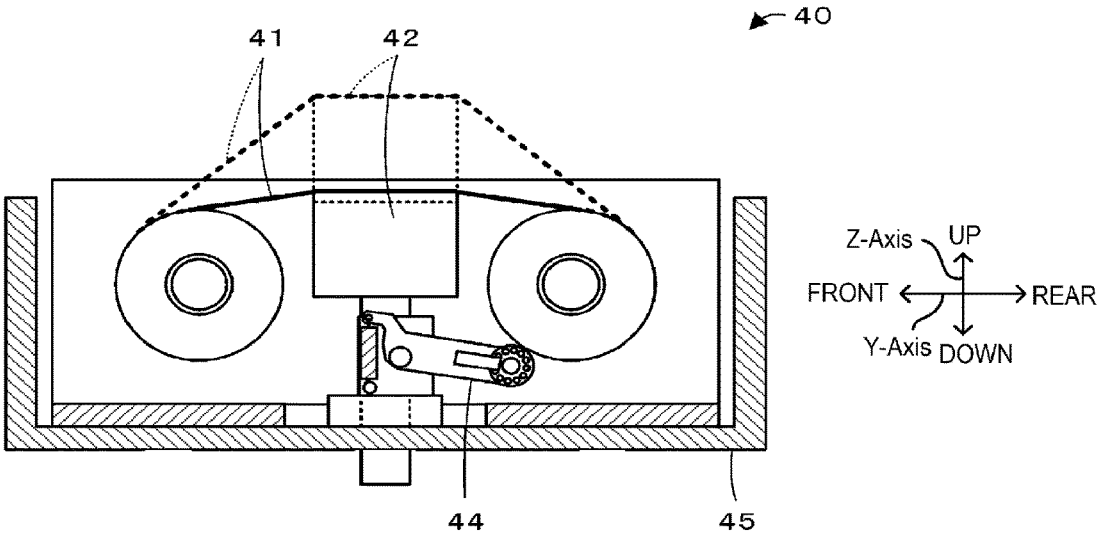
FIG. 5 is a partial cross-sectional view of cleaning unit 40 as viewed from a side surface.
Figure 6:
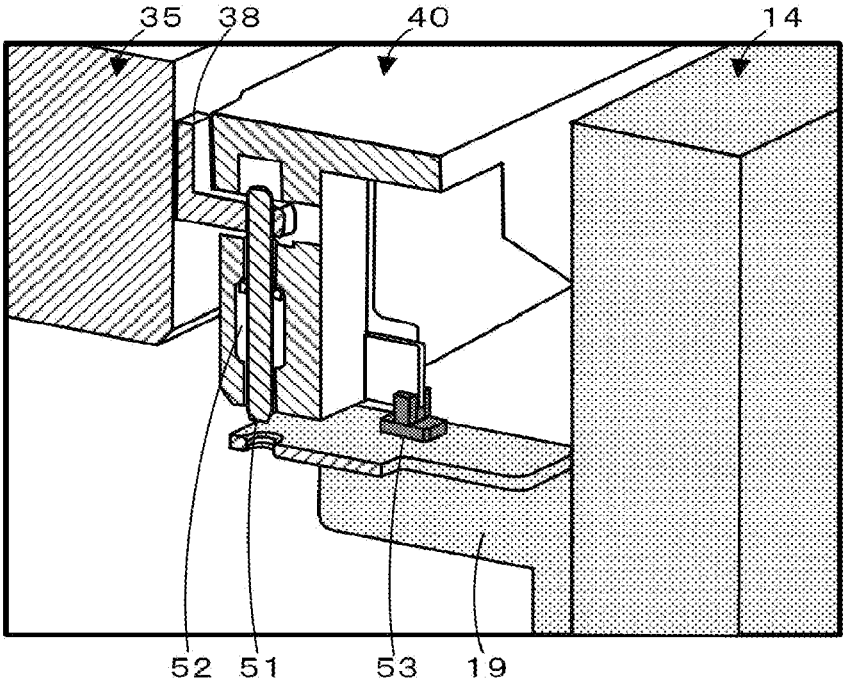
FIG. 6 is an explanatory view of coupling section 50 in a coupling state.
Figure 7:
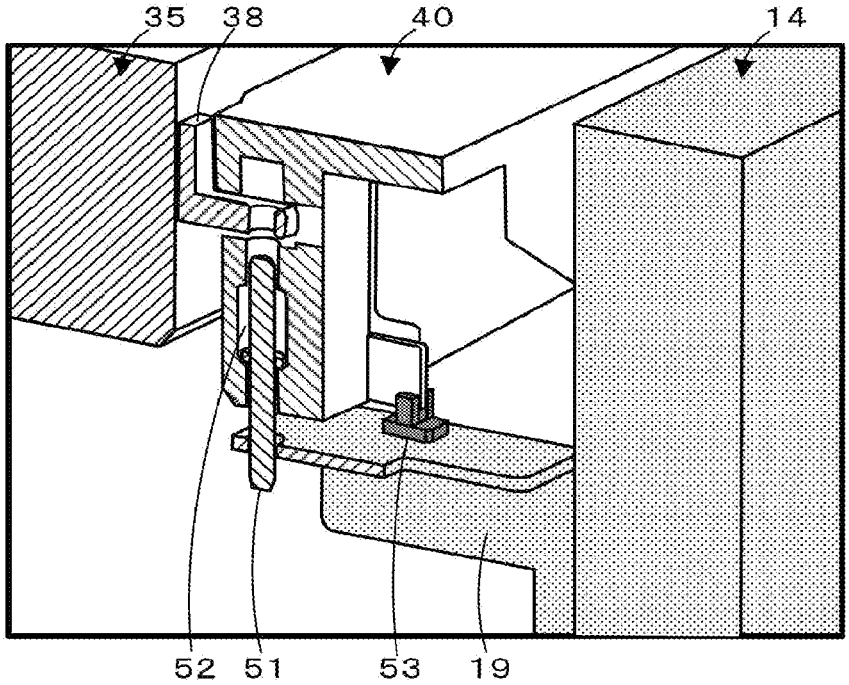
FIG. 7 is an explanatory view of coupling section 50 in a fixed state.
Figure 8:
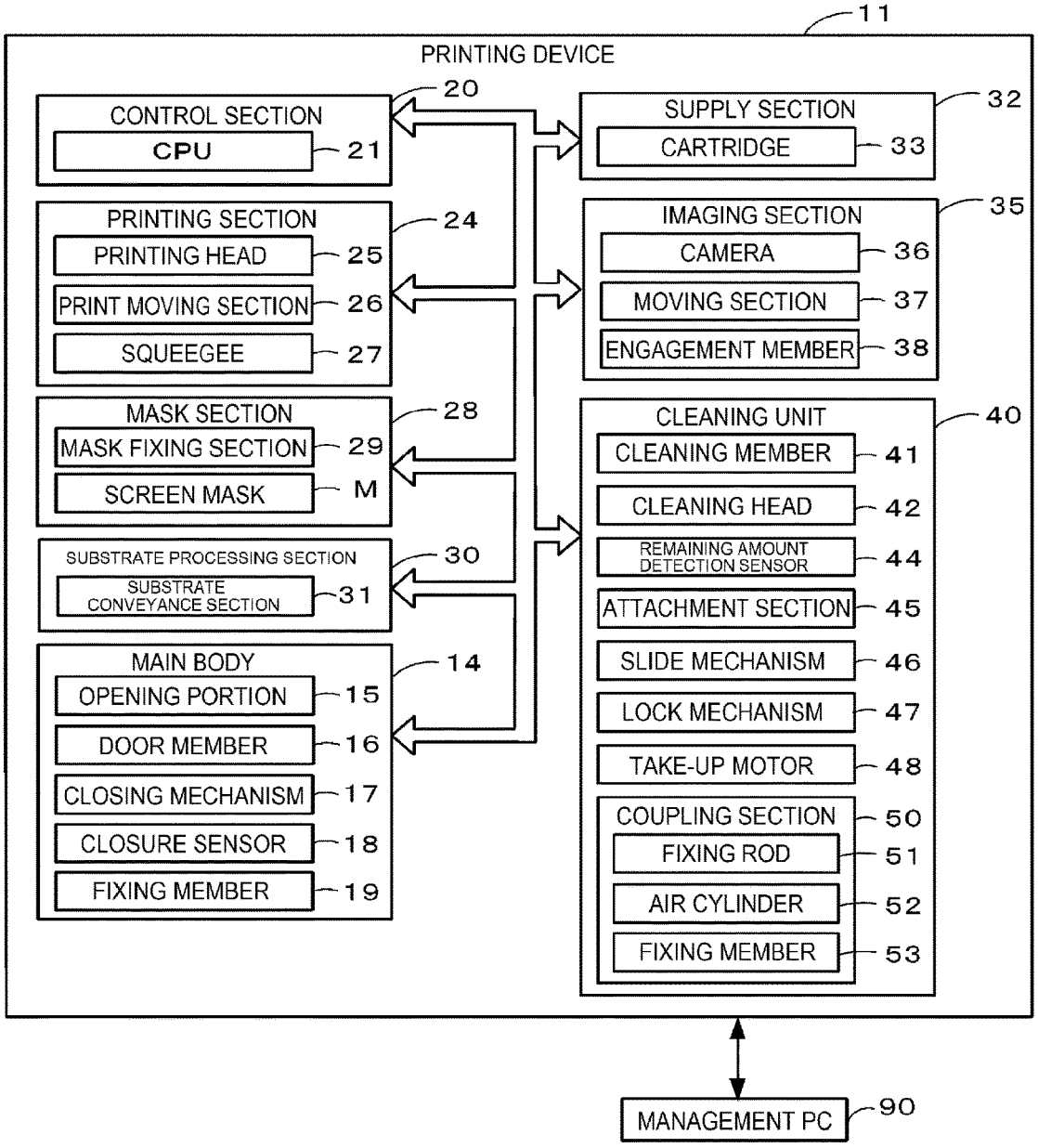
FIG. 8 is a block diagram illustrating an electrical connection relationship of printing device 11.

The present embodiment will be described below with reference to the drawings. FIG. 1 is a schematic explanatory view illustrating an example of mounting system 10 including printing device 11 which is an example of the present disclosure. FIG. 2 is an explanatory view illustrating a state where door member 16 is opened and cleaning unit 40 is pulled out to an outside. FIG. 3 is an explanatory view of closing mechanism 17 and closure sensor 18 as viewed from an inside of main body 14. FIG. 4 is an explanatory view illustrating an example of a configuration of cleaning unit 40, in which FIG. 4A is an exploded perspective view and FIG. 4B is a perspective view. FIG. 5 is a partial cross-sectional view of cleaning unit 40 as viewed from a side surface. FIG. 6 is an explanatory view of coupling section 50 in a coupling state. FIG. 7 is an explanatory view of coupling section 50 in a fixed state. FIG. 8 is a block diagram illustrating an electrical connection relationship of printing device 11. Mounting system 10 is, for example, a system for mounting a component on substrate S. Mounting system 10 includes printing device 11, mounting device 12, and management computer (PC) 90. Mounting system 10 is configured as a mounting line in which multiple mounting devices 12 that mount components on substrate S are disposed on a downstream side of printing device 11. In the present embodiment, a left-right direction (X-axis), a front-rear direction (Y-axis), and an up-down direction (Z-axis) are as illustrated in FIGS. 1, 4, 5, 10, 12, and 13.

Mounting device 12 is a device that mounts a component on substrate S, on which a viscous fluid such as solder paste is printed by printing device 11. Management PC 90 is a device for managing information of each device of mounting system 10. Management PC 90 manages a progress state of each device on the mounting line. Each device of mounting system 10 exchanges information with management PC 90 to obtain information such as progress states of other devices.

Printing device 11 is a device for applying (printing) solder as a viscous fluid to substrate S which is a printing target below via a pattern hole formed in the screen mask M by pushing the solder on screen mask M into a pattern hole formed in screen mask M using squeegee 27. Examples of the "printing target" include substrate S, on which a component is mounted, a three-dimensional object, or the like. Examples of the "viscous fluid" include solder paste, conductive paste, and adhesive. Herein, substrate S and solder will be described below as examples. Printing device 11 includes control section 20 (refer to FIG. 8), printing section 24, mask section 28, substrate processing section 30, supply section 32, imaging section 35, and cleaning unit 40 serving as a cleaning section. Control section 20 is configured as a microprocessor mainly including CPU 21, and controls entire printing device 11. Although described in detail later, control section 20 unlocks door member 16 in a state where moving section 37 and cleaning unit 40 are disconnected and when cleaning unit 40 is located in a standby area. In addition, control section 20 executes a cleaning process after restricting a movement of slide mechanism 46 by lock mechanism 47 in a state where moving section 37 and cleaning unit 40 are connected to each other.

As illustrated in FIG. 2, a door member 16 that opens and closes opening portion 15 and is lockable in a closed state is disposed in main body 14 of printing device 11. Opening portion 15 is an area through which cleaning member 41 passes when cleaning member 41 is moved to an outside of printing device 11 when cleaning unit 40 is in the standby area (refer to FIG. 10). Door member 16 is a cleaning member exchange dedicated door member which is opened only when cleaning member 41 is exchanged. Door member 16 is disposed on a front surface of main body 14 of the printing device so as to open and close opening portion 15 provided on an extension line in a movement direction (front-rear direction) of cleaning unit 40. Door member 16 is pivotably disposed on main body 14 so as to close opening portion 15 in a vertical state and to open opening portion 15 in a horizontal state. As illustrated in FIG. 3, closing mechanism 17 and closure sensor 18 are disposed in printing device 11. Closing mechanism 17 is a mechanism for causing door member 16 to be in a closed state by inserting lock pin 17*a* disposed on main body 14 into a hole portion disposed on door member 16, and includes a solenoid for driving lock pin 17*a*. In addition, a position sensor (not illustrated) is disposed in closing mechanism 17, and thus, a position of lock pin 17*a* can be detected. Closure sensor 18 is a sensor capable of outputting a signal when a sensor member disposed in door member 16 and a detection member disposed on the side of main body 14 are in proximity to each other, and detecting that door member 16 is closed by the output signal.

Printing section 24 is disposed in an upper stage of printing device 11, and is a unit that perform printing process of the viscous fluid on substrate S using screen mask M. Printing section 24 includes printing head 25, print moving section 26, a squeegee raising/lowering section, and squeegee 27. Print moving section 26 moves printing head 25 in a predetermined printing direction (here, the front-rear direction), and includes a slider that moves along a guide formed in the front-rear direction and a motor that drives the slider. Squeegee 27 is disposed on a lower surface side of printing head 25 and is lifted or lowered by a squeegee raising/lowering section. Printing section 24 has two squeegees 27 used in the front-rear direction. Mask section 28 is disposed between printing section 24 and substrate processing section 30 in the up-down direction, and is a unit that fixedly holds screen mask M. Mask section 28 includes mask fixing section 29. Mask fixing section 29 positions screen mask M and supports and fixes screen mask M in a horizontal posture.

Imaging section 35 includes camera 36, moving section 37, and engagement member 38 (refer to FIG. 8). Camera 36 captures images of substrate S and screen mask M. Imaging section 35 captures an image of a reference mark formed on substrate S or screen mask M. Control section 20 performs, for example, position alignment between screen mask M and substrate S based on the captured image. Moving section 37 moves imaging section 35 in a printing direction (the front-rear direction of the device), and includes a slider that moves along a guide formed in the front-rear direction and a motor that drives the slider. Engagement member 38 is a member coupled to cleaning unit 40 by coupling section 50 provided in cleaning unit 40 (refer to FIGS. 6 and 7). Imaging section 35 can be connected to and disconnected from cleaning unit 40, and moving section 37 moves cleaning unit 40 together with camera 36. Although cleaning unit 40 does not have a moving section such as a motor, cleaning unit 40 is coupled to imaging section 35 by coupling section 50, and is moved in the front-rear direction between the cleaning area and the standby area by moving section 37 (refer to FIG. 10).

Substrate processing section 30 is a unit that is disposed below mask section 28, conveys in substrate S, positions and supports carried-in substrate S, and brings substrate S into contact with screen mask M or separates substrate S from screen mask M. Substrate processing section 30 includes substrate conveyance section 31 that conveys substrate S in the left-right direction, a substrate supporting member that supports substrate S from below, and support raising/lowering section that lifts or lowers entire substrate processing section 30 and the substrate supporting member. Supply section 32 is a unit that supplies solder accommodated in cartridge 33 onto screen mask M. Supply section 32 is disposed in front of printing head 25. Supply section 32 applies a pressure to cartridge 33 to discharge the solder from cartridge 33.

Cleaning unit 40 is disposed between mask section 28 and substrate processing section 30 in the up-down direction, and is a unit for performing a cleaning process for cleaning a rear surface of screen mask M. Cleaning unit 40 includes cleaning member 41, cleaning head 42, remaining amount detection sensor 44, attachment section 45, slide mechanism 46, lock mechanism 47, take-up motor 48, and coupling section 50. Cleaning member 41 wipes off an adhered matter adhering to screen mask M, and may be, for example, cleaning paper or the like. As illustrated in FIGS. 4 and 5, cleaning head 42 is a member for cleaning screen mask M by contacting cleaning member 41 for cleaning screen mask M with screen mask M. Cleaning head 42 is a rod-like member having a rectangular parallelepiped shape of which a longitudinal direction is an X-axis direction (left-right direction). Cleaning head 42 is lifted and lowered between a cleaning position (refer to dashed lines in FIG. 5) and a standby position (refer to solid lines in FIG. 5) by a lifting and lowering mechanism (not illustrated) to clean screen mask M at the cleaning position. As illustrated in FIG. 5, remaining amount detection sensor 44 is a sensor that contacts cleaning member 41 and detects a remaining amount (used amount) of cleaning member 41 by rotating in accordance with the winding of cleaning member 41. Control section 20 can predict an exchange time of cleaning member 41 based on a signal from remaining amount detection sensor 44.

Attachment section 45 is a member that rotatably supports cleaning member 41, and attaches cleaning member 41. Attachment section 45 is a box-shaped member having an open upper surface that supports a first shaft and a second shaft over which cleaning member 41 is bridged. Slide mechanism 46 is a mechanism for sliding attachment section 45 to pull attachment section 45 to the outside of printing device 11 (refer to FIG. 2). Slide mechanism 46 is fixed to a left surface and a right surface of attachment section 45 as well as to a housing side of cleaning unit 40, and slides and supports attachment section 45 in the front-rear direction. Lock mechanism 47 is a mechanism for restricting a movement of slide mechanism 46, and includes a restricting pin and a solenoid for driving the restricting pin. Lock mechanism 47 is fixed to the housing side of cleaning unit 40, and restricts the movement of slide mechanism 46 by inserting the restricting pin into a hole portion formed in attachment section 45 to fix attachment section 45 (refer to FIG. 1). Lock mechanism 47 is driven by control section 20. Take-up motor 48 is a motor for rotationally driving a first shaft for winding used cleaning member 41.

Coupling section 50 connects and disconnects cleaning unit 40 and imaging section 35 (moving section 37). Moreover, coupling section 50 serves as a fixing section for fixing cleaning unit 40 to main body 14. That is, coupling section 50 fixes cleaning unit 40 to main body 14 of printing device in the standby area and releases the connection with moving section 37, while connecting cleaning unit 40 and moving section 37 and releasing fixing to main body 14. Coupling section 50 is disposed at a left end portion and a right end portion of cleaning unit 40. As illustrated in FIGS. 6 and 7, coupling section 50 includes fixing rod 51 and air cylinder 52 (driving section). Fixing rod 51 is a rod-like member inserted into air cylinder 52, and is driven by air cylinder 52. Fixing rod 51 moves between a moving section coupling position (FIG. 6) for connecting cleaning unit 40 and moving section 37 and releasing the fixing to main body 14, and a main body fixing position (FIG. 7) for fixing cleaning unit 40 to main body 14 and releasing the connection to moving section 37. Engagement member 38 having an L-shaped insertion hole formed in a horizontal plane is fixed to imaging section 35. In addition, L-shaped fixing member 19 having an insertion hole formed in a horizontal plane in a column member is fixed to main body 14. Fixing rod 51 is inserted only into engagement member 38 in the moving section coupling position, and is inserted only into fixing member 19 in the main body fixing position. Pressurized air (not illustrated) is supplied to air cylinder 52, and thus, fixing rod 51 is driven up and down by switching of a supply path. In addition, fixed detection sensor 53 is disposed on fixing member 19. Fixed detection sensor 53 is a sensor that outputs a signal when a plate-like member disposed in cleaning unit 40 is inserted. Control section 20 can detect that cleaning unit 40 is present in the standby area based on the output signal of fixed detection sensor 53. In addition, a coupling sensor (not illustrated) is disposed in imaging section 35, and thus, it is possible to confirm whether cleaning unit 40 is appropriately coupled. In addition, a position sensor (not illustrated) is disposed in coupling section 50, and thus, a position of fixing rod 51 can be detected.

Figure 9:
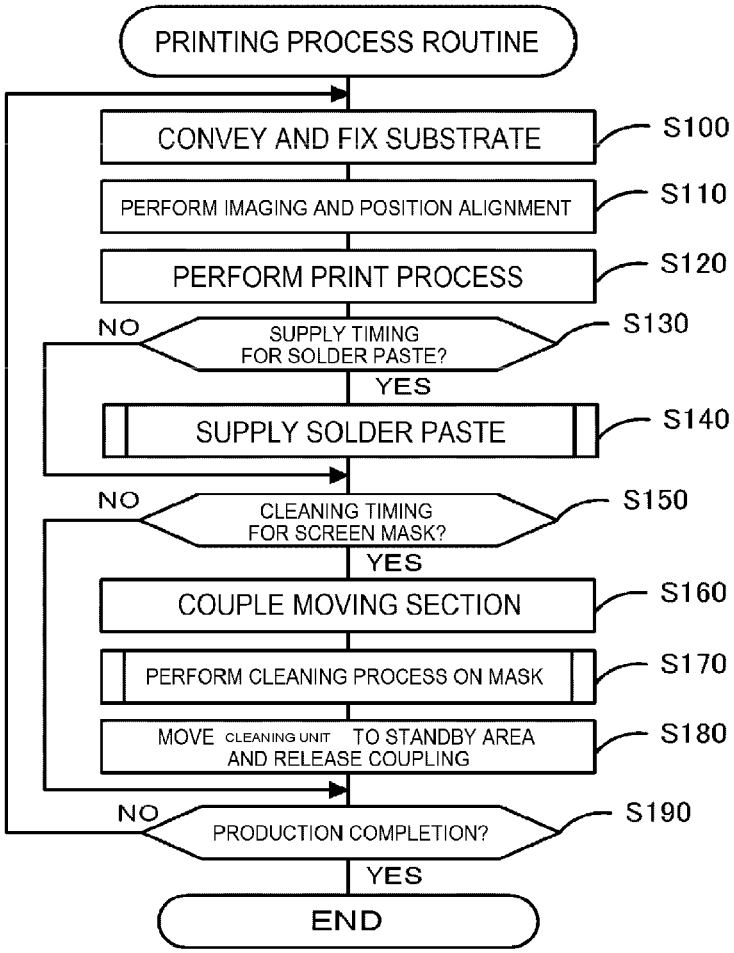
FIG. 9 is a flowchart illustrating an example of a printing process routine.

Next, an operation of printing device 11 configured as described above, first, an operation of the print process will be described. FIG. 9 is a flowchart illustrating an example of a printing process routine executed by CPU 21 of control section 20. This routine is stored in a storage section of control section 20 and executed in accordance with an input of the operator to initiate the print process. When this routine is executed, CPU 21 causes substrate processing section 30 to convey and fix substrate S (S100), causes imaging section 35 to read reference marks of substrate S and screen mask M, to perform the position alignment between substrate S and screen mask M (S110), and causes printing section 24 to execute the print process (S120). In print process, printing head 25 is moved, and the solder paste is supplied onto substrate S disposed on a lower surface of screen mask M by squeegee 27. Next, CPU 21 determines whether it is a supply timing for the solder (S130), and when it is the supply timing for the solder, CPU 21 causes supply section 32 to supply the solder on screen mask M (S140). The determination of the supply timing for the solder may be made by detecting an amount of solder used or by predicting the amount of solder based on a printing time.

Figure 10:
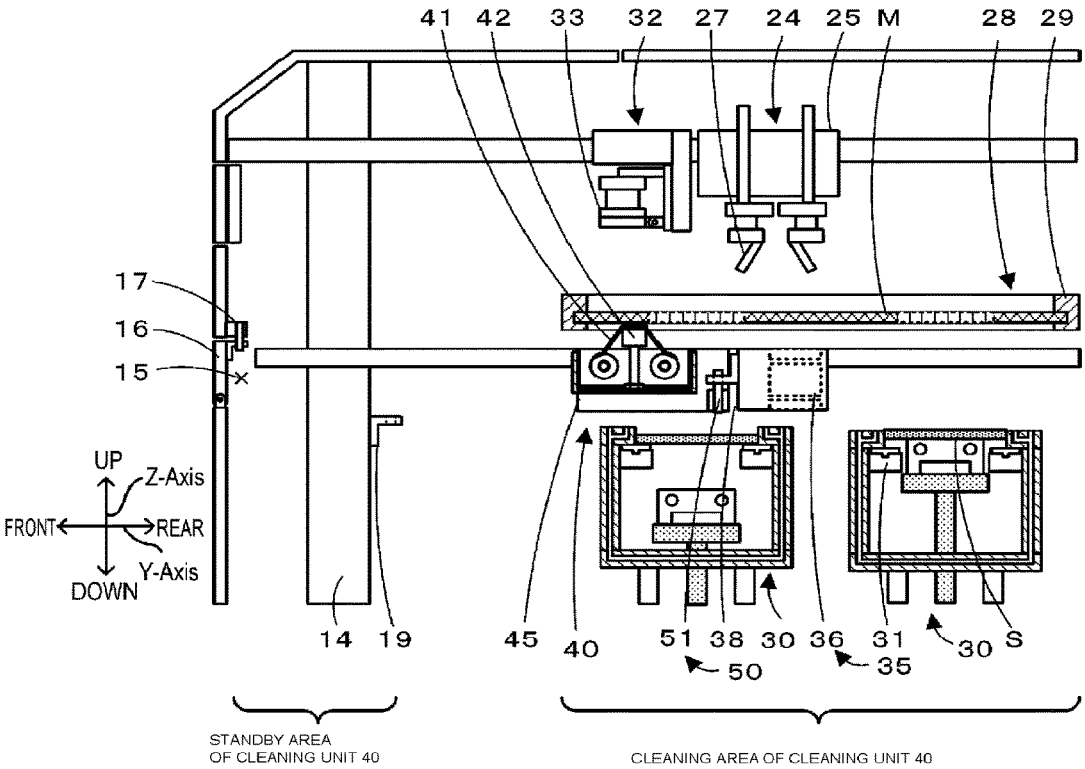
FIG. 10 is an explanatory view of a cleaning process.

After S140 or when it is not the supply timing for the solder in S130, CPU 21 determines whether it is a cleaning timing for screen mask M (S150). This determination can be made based on whether the print process time has elapsed a predetermined cleaning time. When it is the cleaning timing for screen mask M, CPU 21 couples moving section 37 to cleaning unit 40 (S160), and executes the cleaning process of screen mask M by cleaning unit 40 (S170). FIG. 10 is an explanatory view of the cleaning process of screen mask M by cleaning unit 40. In S160, CPU 21 moves imaging section 35 to the vicinity of cleaning unit 40 waiting in the standby area, moves fixing rod 51 of coupling section 50 to the moving section coupling position, couples moving section 37 and cleaning unit 40, and releases the fixing to main body 14. In S170, CPU 21 moves cleaning unit 40 to a lower surface of screen mask M, lifts cleaning head 42 to the cleaning position, and causes cleaning member 41 to clean the lower surface of screen mask M (FIG. 10). When the cleaning process is finished, CPU 21 causes moving section 37 to move cleaning unit 40 to the standby area, moves fixing rod 51 to the main body fixing position, releases the coupling of coupling section 50, and fixes cleaning unit 40 (S180).

After S180 or when it is not the cleaning timing for screen mask M in S150, CPU 21 determines whether a production process of substrate S is completed (S190), and executes processes after S100 when the production process of substrate S is not completed. Meanwhile, when the production process of substrate S is completed in S190, the routine is finished.

Figure 11:
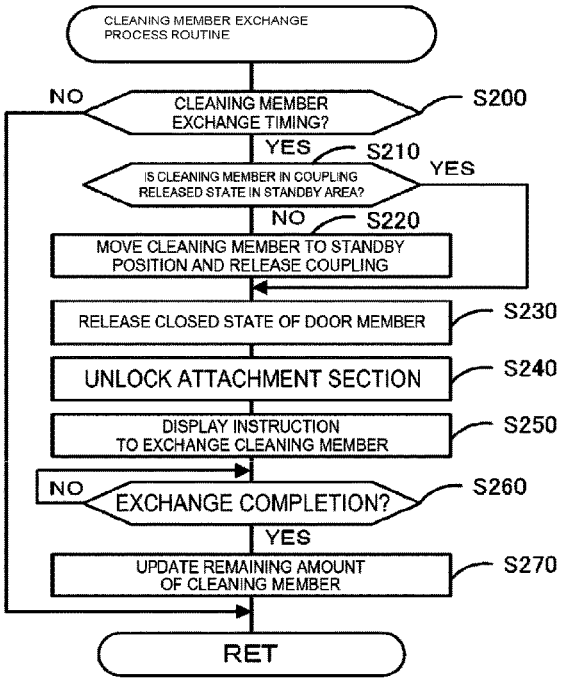
FIG. 11 is a flowchart illustrating an example of a cleaning member exchange process routine.
Figure 12:
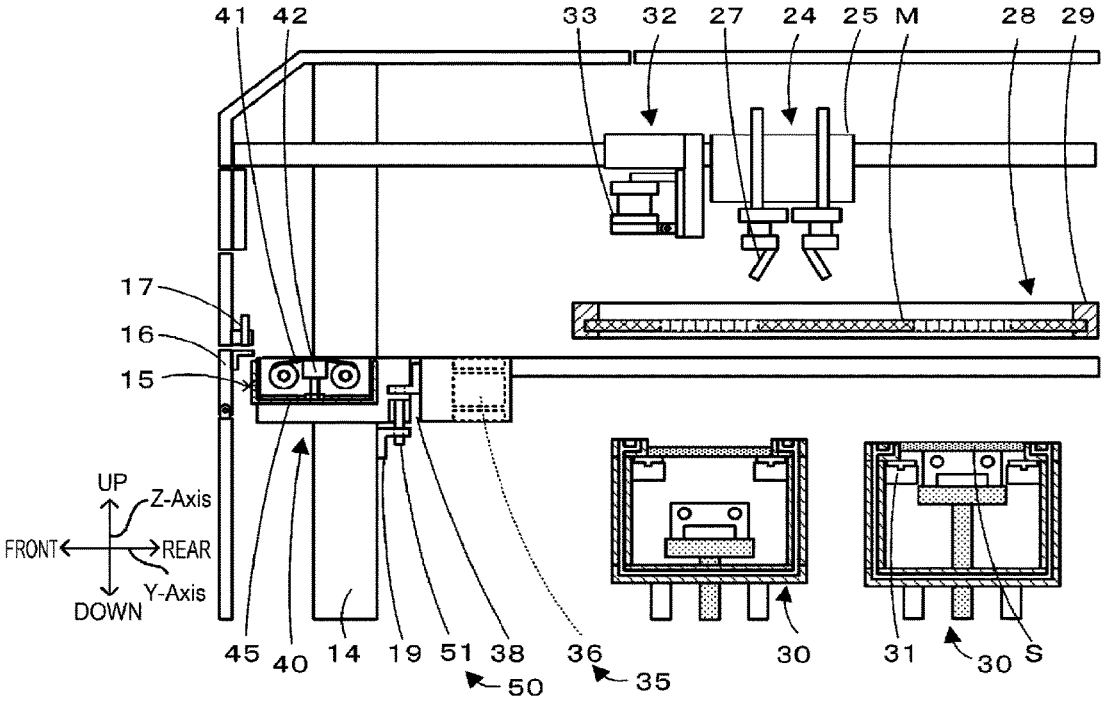
FIG. 12 is an explanatory view of decoupling and main body fixing processes of coupling section 50.

Next, an operation performed when cleaning member 41 of cleaning unit 40 is exchanged will be described. FIG. 11 is a flowchart illustrating an example of a cleaning member exchange process routine executed by CPU 21 of control section 20. This routine is stored in the storage section of control section 20, and is repeatedly executed at predetermined intervals in parallel with the printing process routine. When this routine is executed, CPU 21 determines whether it is an exchange timing for cleaning member 41 based on a remaining amount of cleaning member 41 detected by remaining amount detection sensor 44 (S200). If it is not the exchange timing for cleaning member 41, CPU 21 terminates this routine as it is. Meanwhile, when it is exchange timing for cleaning member 41 in S200, CPU 21 determines whether cleaning unit 40 is in the standby area and the coupling with moving section 37 is released (S210). When cleaning unit 40 is not in the standby area or cleaning unit 40 is coupled to moving section 37, the cleaning unit 40 is moved to the standby area after waiting until the cleaning process currently performed is finished, and the cleaning unit 40 is disconnected (S220). FIG. 12 is an explanatory view of the decoupling and main body fixing process of coupling section 50.

Figure 13:
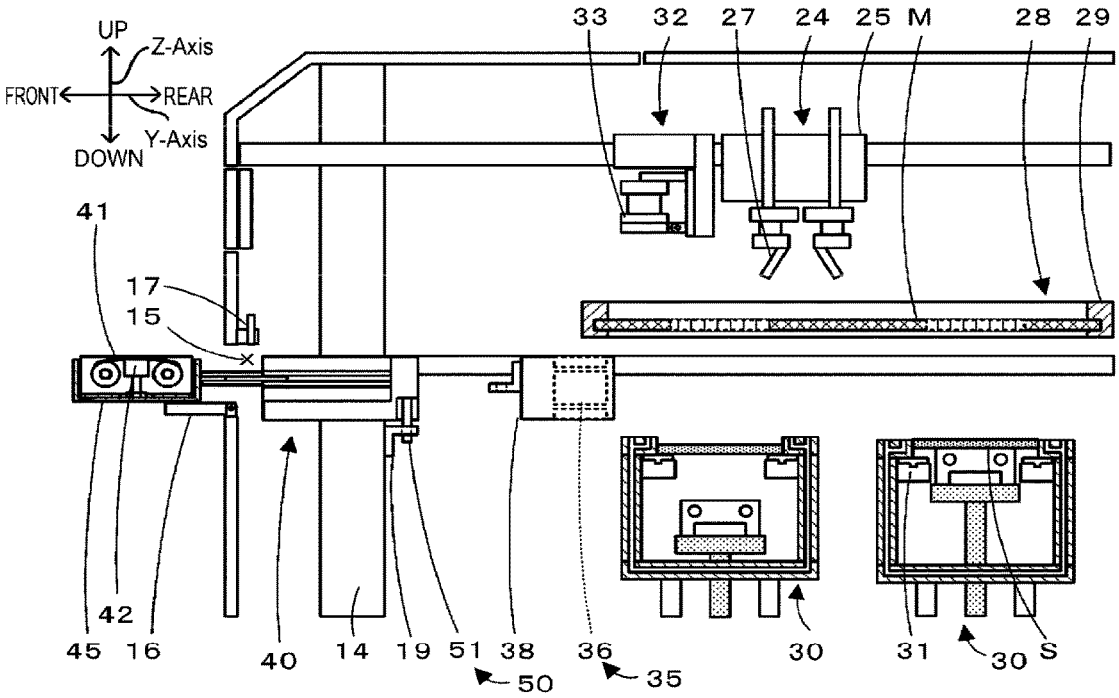
FIG. 13 is an explanatory view illustrating a state where cleaning member 41 is changed by pulling out attachment section 45.

After S220 or when cleaning unit 40 is in the standby area and the coupling with moving section 37 is released in S210, CPU 21 drives lock pin 17*a* of closing mechanism 17 to release the closed state of door member 16 (S230), and drives the restricting pin of lock mechanism 47 to release the locking of the movement restriction of slide mechanism 46 (S240). Subsequently, in S250, CPU 21 causes a display section of an operation panel to display an instruction to exchange cleaning member 41. The operator confirms a display content of the display section, opens door member 16, holds a handle fixed to a front surface of attachment section 45, and moves attachment section 45 to the outside of the device by slide mechanism 46. FIG. 13 is an explanatory view illustrating a state where cleaning member 41 is changed by pulling out attachment section 45. The operator removes used cleaning member 41 (refer to FIG. 4A), attaches new cleaning member 41 (refer to FIG. 4B), moves attachment section 45 into the device, and closes door member 16.

After S250, CPU 21 determines whether an exchange completion input inputted by the operator is acquired from the operation panel (S260), and waits as it is when the exchange completion is not inputted. Meanwhile, when the exchange completion is inputted in S260, the remaining amount of cleaning member 41 is updated (S270), and the routine is finished. In printing device 11, since door member 16 is opened only when cleaning member 41 is exchanged, the printing process routine and the cleaning member exchange process routine can be executed in parallel, and thus, the cleaning member 41 can be exchanged without stopping the print process at all.

Here, correspondence relationships between constituent elements of the present embodiment and constituent elements of the present disclosure will be clarified. Screen mask M of the present embodiment corresponds to a screen mask, substrate S corresponds to a printing target, the solder paste corresponds to a viscous fluid, cleaning member 41 corresponds to a cleaning member, cleaning head 42 corresponds to a cleaning head, moving section 37 corresponds to a moving section, opening portion 15 corresponds to an opening portion, closing mechanism 17 corresponds to a closing mechanism, door member 16 corresponds to a door member, and control section 20 corresponds to a control section. In addition, main body 14 corresponds to a main body, coupling section 50 corresponds to a coupling section, fixing rod 51 corresponds to a fixing rod, air cylinder 52 corresponds to a driving section, attachment section 45 corresponds to an attachment section, slide mechanism 46 corresponds to a slide mechanism, lock mechanism 47 corresponds to a lock mechanism, imaging section 35 corresponds to an imaging section, and printing section 24 corresponds to the printing section. In the present embodiment, a cleaning unit of the present disclosure and a control method for a printing device of the present disclosure are disclosed by descriptions of printing device 11.

In printing device 11 of the present embodiment described above, in a state where moving section 37 and cleaning unit 40 are disconnected from each other and in a state where cleaning unit 40 is located in the standby area, door member 16 that opens and closes opening portion 15 in the vicinity of the standby area is unlocked. In this printing device 11, when door member 16 is made openable, since cleaning unit 40 is in the standby area and closes opening portion 15, an operator is prevented from accessing inside of the device from opening portion 15, and thus, security can be secured. In addition, when printing device 11 allows door member 16 to be opened, since cleaning unit 40 is disconnected from moving section 37, it is also prevented from moving from the standby area. It should be noted that although door member 16 is locked in the closed state when cleaning unit 40 is not in the standby area, there is no reason to open door member 16, and thus, usability is not obstructed. Then, the operator can expose cleaning member 41 to the outside through opening portion 15 opened by door member 16 to exchange cleaning member 41. Accordingly, in printing device 11, when exchange cleaning member 41, it is possible to further suppress interruption of a process related to printing, such as, for example, convey-in and convey-out processes of substrate S, a supply process of the viscous fluid, positioning processing between screen mask M and substrate S, in addition to the print process itself, while securing security.

In addition, cleaning unit 40 includes coupling section 50 that fixes cleaning unit 40 to main body 14 side in the standby area and releases the connection with moving section 37, while connecting cleaning unit 40 and moving section 37 and releasing the fixing to main body 14 side. In printing device 11, the movement and the fixing of cleaning unit 40 can be switched by using coupling section 50. In addition, coupling section 50 includes fixing rod 51 that moves between the main body fixing position for fixing cleaning unit 40 to main body 14 side and releasing the connection to moving section 37 and the moving section coupling position for connecting cleaning unit 40 and moving section 37 and releasing the fixing to main body 14 side, and air cylinder 52 serving as the driving section for moving fixing rod 51 between the main body fixing position and the moving section coupling position. In printing device 11, the movement and the fixing of cleaning unit 40 can be switched by a relatively simple structure.

In addition, cleaning unit 40 includes attachment section 45 to which cleaning member 41 is attached, slide mechanism 46 that slides attachment section 45 to pull attachment section 45 to the outside of printing device 11, and lock mechanism 47 that restricts the movement of slide mechanism 46, and control section 20 releases the restriction of lock mechanism 47 in the state where moving section 37 and cleaning unit 40 are disconnected from each other and in the state where cleaning unit 40 is in the standby area. In printing device 11, cleaning member 41 can be moved to the outside relatively easily by using slide mechanism 46 having a simpler configuration. In addition, in printing device 11, since the operation restriction of slide mechanism 46 is released in a state where cleaning member 41 is exchangeable, it is possible to prevent cleaning member 41 from being inadvertently pulled out to the outside. In addition, control section 20 executes the cleaning process after restricting the movement of slide mechanism 46 by lock mechanism 47 in a state where moving section 37 and cleaning unit 40 are connected to each other. In printing device 11, security can be further secured by restricting the operation of slide mechanism 46 by lock mechanism 47 when cleaning unit 40 performs the cleaning process.

Furthermore, door member 16 is disposed on main body 14 side of printing device 11 so as to open and close opening portion 15 provided on the extension line in the movement direction of cleaning unit 40. In this printing device 11, since there are opening portion 15 and door member 16 through which cleaning member 41 passes in the movement direction of cleaning unit 40, the movement direction is unified, and thus, cleaning member 41 can be easily moved to the outside. Moreover, door member 16 is pivotably disposed on main body 14 side so as to close opening portion 15 in the vertical state and to open opening portion 15 in the horizontal state. In this printing device 11, since cleaning member 41 is exchanged in a state where cleaning member 41 passes through opening portion 15 and is pulled out of the device, it is possible to realize compactness of the device. Further, moving section 37 is imaging section 35 including camera 36 for capturing an image of at least one of the printing target and screen mask M. In printing device 11, since moving section 37 moves both imaging section 35 and cleaning unit 40, the device configuration can be further simplified. Moreover, printing device 11 further includes printing section 24 that performs the print process of the viscous fluid (solder paste) on the printing target (substrate S) using screen mask M. In printing device 11, the print process can be performed by printing section 24.

It should be noted that the printing device, the cleaning unit, and the control method for the printing device of the present disclosure are not limited to any of the above embodiments, and may be implemented in various manners as long as they fall within a technical scope of the present disclosure.

For example, in the above embodiment, coupling section 50 has fixing rod 51 and air cylinder 52 that switch the coupling between cleaning unit 40 and moving section 37 and the fixing of cleaning unit 40 to main body 14; however, the configuration is not limited to this, and a member that couples cleaning unit 40 and moving section 37 and a member that fixes cleaning unit 40 to main body 14 side may be separate members. Although the number of members increases even in printing device, it is possible to further suppress the interruption of the process related to the printing while securing security when cleaning member 41 is exchanged.

In the above embodiment, cleaning unit 40 includes attachment section 45, slide mechanism 46, and lock mechanism 47, and only attachment section 45 is pulled out of the device; however, the configuration is not limited to this. For example, in printing device 11, attachment section 45, slide mechanism 46, and lock mechanism 47 may be omitted, and thus, cleaning unit 40 itself may be pulled out of opening portion 15. Even in this printing device, it is possible to further suppress the interruption of the process while securing security when cleaning member 41 is exchanged.

In the above embodiment, door member 16 is provided in opening portion 15 provided on the extension line in the movement direction (printing direction, front-rear direction) of cleaning unit 40, and cleaning member 41 is moved from opening portion 15 to the outside; however, the configuration is not limited to this. For example, door member 16 may be disposed in an opening portion provided in a direction different from the movement direction of cleaning unit 40, and thus, cleaning member 41 may be moved to the outside from the opening portion. Although the direction in which cleaning member 41 is removed may be arbitrary, it is preferable that cleaning member 41 moves to the outside along the movement direction of cleaning unit 40.

In the above embodiment, door member 16 is configured to close opening portion 15 in the vertical state and to open opening portion 15 in the horizontal state; however, an opening operation of door member 16 is not particularly limited to this and is arbitrary as long as door member 16 can be opened. For example, door member 16 may be pivoted toward the front-down direction, or may be pivoted toward the front-up direction to open opening portion 15. It should be noted that in view of the exchange of cleaning member 41, it is preferable that door member 16 pivots toward the front-down direction.

In the above embodiment, moving section 37 moves imaging section 35 and cleaning unit 40; however, the configuration is not limited to this, cleaning unit 40 may be moved by a moving section different from imaging section 35. Although the number of moving sections increases even in printing device, it is possible to further suppress the interruption of the process related to the printing while securing security when cleaning member 41 is exchanged.

In the above embodiment, door member 16 is locked by closing mechanism 17 including lock pin 17*a* and solenoid; however, the configuration is not limited to this as long as door member 16 can be locked in the closed state. Similarly, in printing device 11, the coupling or fixing of cleaning unit 40 is performed by fixing rod 51 and air cylinder 52; however, the configuration is not limited to this. Moreover, lock mechanism 47 includes the restricting pin and the solenoid for driving the restricting pin, and is inserted into the attachment section 45; however, the configuration is not limited to this as long as lock mechanism 47 restricts the movement of slide mechanism 46. Lock mechanism 47 may restrict the slide itself of slide mechanism 46. As such a mechanism, a mechanism having known shape and action can be appropriately used.

In the above embodiment, door member 16 is disposed on the main body side, and fixing rod 51 is inserted into fixing member 19 disposed on main body 14, that is, door member 16 and fixing rod 51 are fixed to the main body side; however, examples of the member on the main body side include a housing, a fixing member, a cover member, and a column member disposed in the main body as long as it is not a member that frequently moves or operates as in cleaning unit 40.

In the above embodiment, the present disclosure has been described as printing device 11 including cleaning unit 40; however, the present disclosure is not limited to this, and may be only cleaning unit 40 or may be the control method for printing device 11.

The printing device, the cleaning unit, and the control method for the printing device of the present disclosure may be configured as follows. For example, in the printing device of the present disclosure, the cleaning section may include a coupling section configured to fix the cleaning section to a main body side of the printing device in the standby area and release connection with the moving section, while connecting the cleaning section and the moving section and releasing the fixing to the main body side of the printing device. In this printing device, the movement and the fixing of the cleaning section can be switched by using the coupling section. In this case, the coupling section may include a fixing rod that moves between a main body fixing position for fixing the cleaning section to the main body side and releasing the connection to the moving section and the moving section coupling position for connecting the cleaning section and the moving section and releasing the fixing to main body side, and a driving section for moving the fixing rod between the main body fixing position and the moving section coupling position. In this printing device, the movement and the fixing of the cleaning section can be switched by a relatively simple structure.

In the printing device of the present disclosure, the cleaning section may include an attachment section configured to attach the cleaning member, a slide mechanism configured to slide the attachment section to pull the attachment section to the outside of the printing device, and a lock mechanism configured to restrict a movement of the slide mechanism, and the control section may release the restriction of the lock mechanism in a state where the moving section and the cleaning section are disconnected from each other and in a state where the cleaning section is located in the standby area. In this printing device, the cleaning member can be moved to the outside relatively easily using the slide mechanism having a simpler configuration. In addition, in this printing device, since the operation restriction of the slide mechanism is released in a state where the cleaning member is exchangeable, it is possible to prevent the cleaning member from being inadvertently pulled out to the outside. In this case, the control section may execute the cleaning process after restricting the movement of the slide mechanism by the lock mechanism in a state where the moving section and the cleaning section are connected to each other. In this printing device, security can be further secured by restricting the operation of the slide mechanism by the lock mechanism when the cleaning section performs the cleaning process.

In the printing device of the present disclosure, the door member may be disposed on the main body side of the printing device so as to open and close an opening portion provided on an extension line in a movement direction of the cleaning section. In this printing device, since there are the opening portion and the door member through which the cleaning member passes in the movement direction of the cleaning section, the movement direction is unified, and thus, the cleaning member can be easily moved to the outside. In the printing device, the door member may be pivotably disposed on the main body side so as to close the opening portion in a vertical state and to open the opening portion in a horizontal state. In this printing device, since the cleaning member is exchanged in a state where the cleaning member passes through the opening portion and is pulled out of the device, it is possible to realize compactness of the device. It should be noted that the "main body side" does not mean a member that frequently moves or operates such as a cleaning section, but includes a housing that is a main body, a fixing member, a cover member, a column member, and the like disposed in the main body.

In the printing device of the present disclosure, the moving section may include an imaging section configured to capture an image of the printing target and/or the screen mask. In this printing device, since the moving section moves both the imaging section and the cleaning section, the device configuration can be further simplified.

The printing device of the present disclosure may include a printing section configured to perform the print process of the viscous fluid on the printing target using the screen mask. In this printing device, the print process can be performed by a printing section.

According to the present disclosure, there is provided a cleaning unit used in a printing device for performing a print process of a viscous fluid on a printing target using a screen mask, the cleaning unit including a cleaning head configured to contact a cleaning member with the screen mask to perform a cleaning process on the screen mask, and a control section configured to unlock a door member configured to open and close an opening portion through which the cleaning member passes when the cleaning member is moved from a standby area to an outside of the printing device and be lockable in a closed state in a state where a moving section connectable and disconnectable to the cleaning unit and moving the cleaning unit between a cleaning area and the standby area and the cleaning unit are disconnected to each other and in a state where the cleaning unit is located in the standby area.

Since the cleaning unit has the same configuration as that of the printing device, similarly to the printing device, it is possible to further suppress the interruption of the processing while securing security when exchanging the cleaning member used in the printing device. It should be noted that various modes of the above-described printing device may be employed in the cleaning unit, and a configuration for realizing each function of the above-described printing device may be added.

According to the present disclosure, there is provided a control method for a printing device for performing a print process of a viscous fluid on a printing target using a screen mask, the printing device including a cleaning section configured to contact a cleaning member with the screen mask to perform a cleaning process on the screen mask, a moving section connectable and disconnectable to the cleaning section to move the cleaning section between a cleaning area and a standby area, and a door member configured to open and close an opening portion through which the cleaning member passes when the cleaning member is moved from the standby area to an outside of the printing device and be lockable in a closed state, the control method including unlocking the door member in a state where the moving section and the cleaning section are disconnected from each other and the cleaning section is located in the standby area.

In the control method for the printing device, since the same process as that of the printing device is performed, similarly to the printing device, it is possible to further suppress the interruption of the process while securing security when exchanging the cleaning member used in the printing device. It should be noted that various modes of the above-described printing device may be employed in the control method for the printing device, and a step for realizing each function of the above-described printing device may be added.

INDUSTRIAL APPLICABILITY

The present disclosure can be used in a technical field of a device for printing a viscous fluid on a printing target.

REFERENCE SIGNS LIST

10: mounting system, 11: printing device, 12: mounting device, 14: main body, 15: opening portion, 16: door member, 17: closing mechanism, 17a: lock pin, 18: closure sensor, 19: fixing member, 20: control section, 21: CPU, 24: printing section, 25: printing head, 26: print moving section, 27: squeegee, 28: mask section, 29: mask fixing section, 30: substrate processing section, 31: substrate conveyance section, 32: supply section, 33: cartridge, 35: imaging section, 36: camera, 37: moving section, 38: engagement member, 40: cleaning unit, 41: cleaning member, 42: cleaning head, 44: remaining amount detection sensor, 45: attachment section, 46: slide mechanism, 47: lock mechanism, 48: take-up motor, 50: coupling section, 51: fixing rod, 52: air cylinder, 53: fixed detection sensor, 90: management PC, M: screen mask, S: substrate

The invention claimed is:

1. A printing device for performing a print process of a viscous fluid on a printing target using a screen mask, the printing device comprising:

a cleaning section having a cleaning head configured to contact a cleaning member with the screen mask to perform a cleaning process on the screen mask;

a moving section connectable and disconnectable to the cleaning section to move the cleaning section between a cleaning area and a standby area;

a door member configured to open and close an opening portion through which the cleaning member passes when the cleaning member is moved from the standby area to an outside of the printing device and be lockable in a closed state; and a control section configured to unlock the door member in a state where the moving section and the cleaning section are disconnected from each other and in a state where the cleaning section is located in the standby area.

2. The printing device according to claim 1, wherein the cleaning section includes a coupling section configured to fix the cleaning section to a main body side of the printing device in the standby area and release connection with the moving section, while connecting the cleaning section and the moving section and releasing the fixing to the main body side of the printing device.

3. The printing device according to claim 1, wherein the cleaning section includes an attachment section configured to attach the cleaning member, a slide mechanism configured to slide the attachment section to pull the attachment section to the outside of the printing device, and a lock mechanism configured to restrict a movement of the slide mechanism, and the control section releases the restriction of the lock mechanism in a state where the moving section and the cleaning section are disconnected from each other and in a state where the cleaning section is located in the standby area.

4. The printing device according to claim 3, wherein the control section executes the cleaning process after restricting the movement of the slide mechanism by the lock mechanism in a state where the moving section and the cleaning section are connected to each other.

5. The printing device according to claim 1, wherein the door member is disposed on a main body side of the printing device so as to open and close an opening portion provided on an extension line in a movement direction of the cleaning section.

6. The printing device according to claim 1, wherein the moving section includes an imaging section configured to capture an image of the printing target and/or the screen mask.

7. The printing device according to claim 1, further comprising a printing section configured to perform the print process of the viscous fluid on the printing target using the screen mask.

8. A cleaning unit used in a printing device for performing a print process of a viscous fluid on a printing target using a screen mask, the cleaning unit comprising:

a cleaning head configured to contact a cleaning member with the screen mask to perform a cleaning process on the screen mask; and a control section configured to unlock a door member configured to open and close an opening portion through which the cleaning member passes when the cleaning member is moved from a standby area to an outside of the printing device and be lockable in a closed state in a state where a moving section connectable and disconnectable to the cleaning unit and moving the cleaning unit between a cleaning area and the standby area and the cleaning unit are disconnected from each other and in a state where the cleaning unit is located in the standby area.

9. A control method for a printing device for performing a print process of a viscous fluid on a printing target using a screen mask, the printing device including a cleaning section having a cleaning head configured to contact a cleaning member with the screen mask to perform a cleaning process on the screen mask, a moving section connectable and disconnectable to the cleaning section to move the cleaning section between a cleaning area and a standby area, and a door member configured to open and close an opening portion through which the cleaning member passes when the cleaning member is moved from the standby area to an outside of the printing device and be lockable in a closed state, the control method comprising:

unlocking the door member in a state where the moving section and the cleaning section are disconnected from each other and the cleaning section is located in the standby area.

* * * * *